United States Patent [19]

Predazzer

[11] Patent Number: 4,905,394

[45] Date of Patent: Mar. 6, 1990

[54] TOP MOUNTED LONGITUDINAL MAGAZINE

[75] Inventor: René Predazzer, Flemalle, Belgium

[73] Assignee: Fabrique Nationale Herstal, Herstal, Belgium

[21] Appl. No.: 304,270

[22] Filed: Jan. 31, 1989

[30] Foreign Application Priority Data

Mar. 2, 1988 [BE] Belgium ..... 8800235

[51] Int. Cl.[4] ..... F41C 25/02

[52] U.S. Cl. ..... 42/17; 42/50; 89/33.1

[58] Field of Search ..... 89/33.1; 42/17, 50

[56] References Cited

U.S. PATENT DOCUMENTS

| | | | |
|---|---|---|---|
| 1,451,339 | 4/1923 | Kottas | 42/17 |
| 2,358,792 | 9/1944 | Conway | 42/17 |
| 2,448,081 | 8/1948 | Conway | 42/17 |
| 2,758,403 | 8/1956 | Hill | 42/17 |
| 2,882,635 | 4/1959 | Hill | 42/17 |
| 2,903,809 | 9/1959 | Stoner | 42/50 |
| 3,021,761 | 2/1962 | Tillander | 89/32.14 |
| 3,465,463 | 9/1969 | Grandy et al. | 42/50 |
| 4,286,499 | 9/1981 | Gillum | 42/50 |

FOREIGN PATENT DOCUMENTS

| | | |
|---|---|---|
| 545725 | 10/1959 | Belgium . |
| 544859 | 2/1932 | Fed. Rep. of Germany . |
| 557686 | 12/1943 | United Kingdom . |

*Primary Examiner*—Charles T. Jordan
*Assistant Examiner*—Michael J. Carone
*Attorney, Agent, or Firm*—Bacon & Thomas

[57] ABSTRACT

Longitudinal magazine for individual weapons such as, submachine gun, rifle, machine-gun and similar, of a type that can be mounted on the upper part of the weapon and in the axis of the frame, characterized in that this magazine mainly consists in a first part (3) formed by a tube forming the magazine as such and in which the cartridges (5) are being stored with their longitudinal axis perpendicular to the longitudinal axis of the magazine (2); a second part (4) consisting in a transfer element (34) showing on both sides an oblong port respectively (32–46), mutually related with two skews (41–42) stretching over an angle of 90 degrees, one of these ports (32) constituting the connection between aforementioned parts (3) and (4) while the second port (46) constitutes the connection between aforementioned part (3) and the weapon (1) with which the magazine (2) cooperates; and in means (54) allowing for the transport of the cartridges (5) inside the magazine (2).

22 Claims, 4 Drawing Sheets

TOP MOUNTED LONGITUDINAL MAGAZINE

Present invention concerns a magazine for individual weapons such as a submachine gun, a rifle, a machine-gun and similar.

It is known that a weapon equipped with its magazine must be easy to carry, compact and allow for any shooting position in the field, etc. . . . .

In order to fulfill these conditions magazines have already been proposed which are placed either underneath the weapon, or on the side of the weapon, or even on top of the weapon.

In the two first solutions the magazine is placed in such manner that it forms a rather substantial projecting part on the weapon where as a result aforementioned conditions can not possibly be met.

The third type of magazines placed on top of the weapon and along its longitudinal plane do however meet all required conditions.

Present invention concerns magazines of the aforementioned third type.

An initial solution for such a kind of magazine has already been divulged in the U.S. Pat. No. 2,624,241.

This solution consists in providing for a relatively long magazine equipped with a load/supply port at one of its extremities. This magazine is to connected on the top side of the weapon's body, in the axis of latter, said port locating itself at the location of the supply area. Latter contains a transfer device in the form of a cylinder, activated by the weapon's bolt and destined to lodge a cartridge at each time in order to swivel it over 90 degrees in order to bring it into the axis of the barrel.

This solution however has the major disadvantage that the transfer device consists in a revolving element which not only makes the weapon's manufacturing, and more particularly the magazine, more difficult by increasing its cost price, but such a revolving element increases the jamming risks resulting in an under par operational reliability.

Another solution has been proposed by the Belgian patent No. 872,033.

This patent describes a longitudinal magazine showing a prismatic tube form closed at both extremities and showing in the central part of one of its longitudinal walls, a loading/supply port, two symmetrical transport devices being provided in aforementioned tube of which each rests individually on one end wall of latter.

Said loading/supply port is limited, here and there, by a body presenting three vanes, the surface connecting two successive vanes being cylindrical corresponding to the ammunition's calibre.

The function of these two bodies is to ensure alternately the exit of a cartridge through said port.

The magazine described in the Belgian patent No. 872,033 also presents the disadvantage of consisting in revolving bodies, resulting in a jamming possibility and here as well in an under par operational reliability.

The aim of present invention is to mitigate these disadvantages by suggesting a longitudinal magazine placed on top of the weapon, allowing for the swiveling movement of the cartridges over an angle of 90 degrees without the intervention of rotating elements.

For this purpose present invention consists in a magazine mainly constituted by a first part in a tubular form forming the magazine as such and in which the cartridges are stored with their longitudinal axis in a perpendicular position with respect to the longitudinal axis of the magazine; a second part consisting in a transfer element showing on both sides an oblong port respectively mutually related by two skews extending over a 90 degree angle, one of these ports constituting the connection between said parts and while the second port constitutes the connection between said part and the weapon on which the magazine is located. Latter port is namely constituted of lips which, on the one hand, ensure correct positioning of the cartridge while being supplied to the weapon's chamber and, on the other hand, hold ammunition in position in the magazine during its handling and its transport without the weapon.

In this way a highly reliable and efficient operationally safe longitudinal magazine is achieved, the number of parts being reduced to a minimum, while avoiding the use of rotating parts and thus allowing to produce a smaller sized weapon and without the magazine constituting a projection with respect to the weapon as such.

In order to achieve better understanding, an embodiment of a magazine according to the invention is described hereafter by way of example, but without any limitation, whereby reference is made to the accompanying drawings, in which:

FIG. 1 represents a weapon, as it is a submachine gun 1, equipped with a magazine 1 according to the invention.

Figure 1:
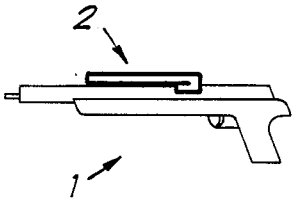
FIG. 1 represents a side view of a weapon, as it is, a submachine gun equipped with a magazine according to the invention.
Figure 2:
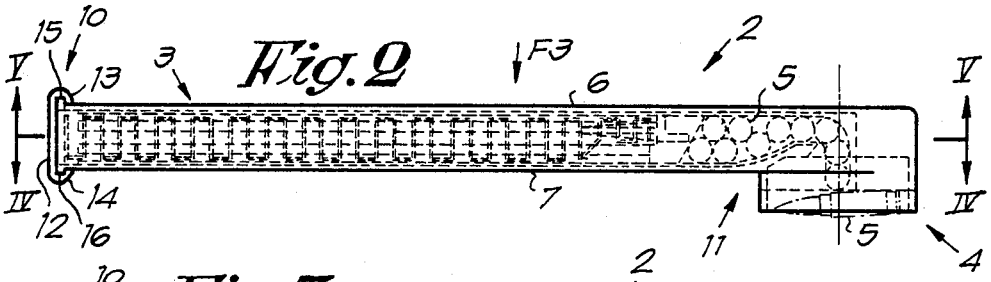
FIG. 2 represents a lateral view of the magazine according to the invention, the magazine being partially loaded.
Figure 3:
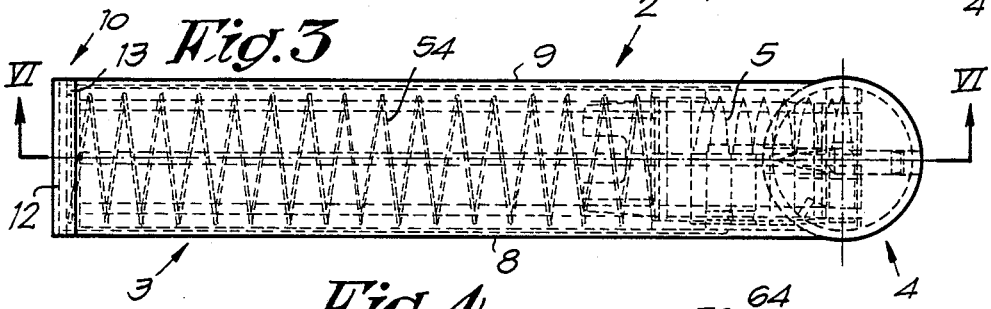
FIG. 3 represents a view according to arrow F3 in FIG. 2.
Figure 4:
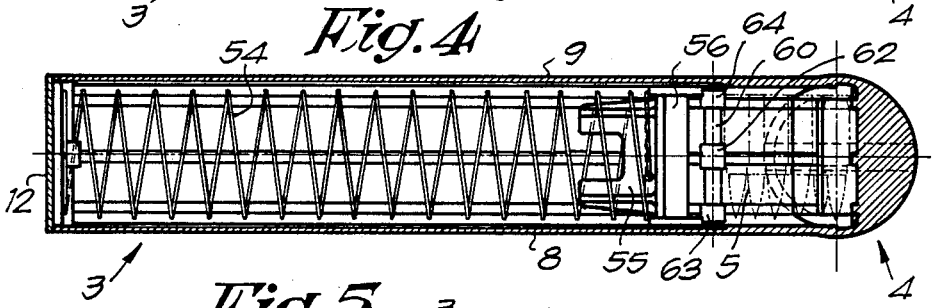
FIGS. 4 and 5 represent cross sections according to lines IV—IV and V—V in FIG. 2.
Figure 5:
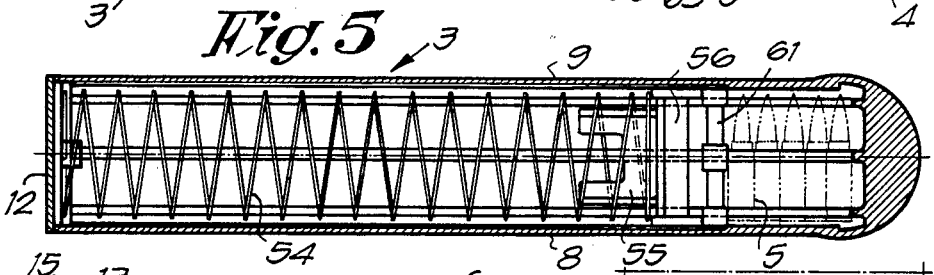
Figure 6:
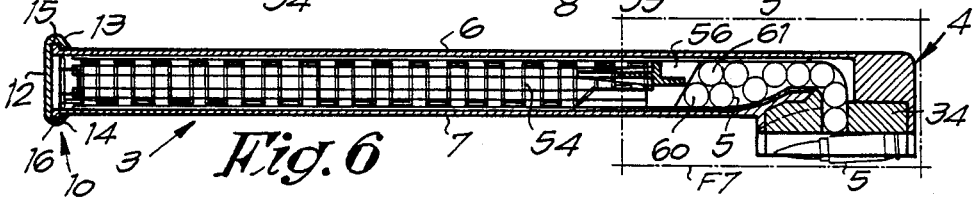
FIG. 6 represents a cross section according to line VI—VI in FIG. 3.
Figure 19:
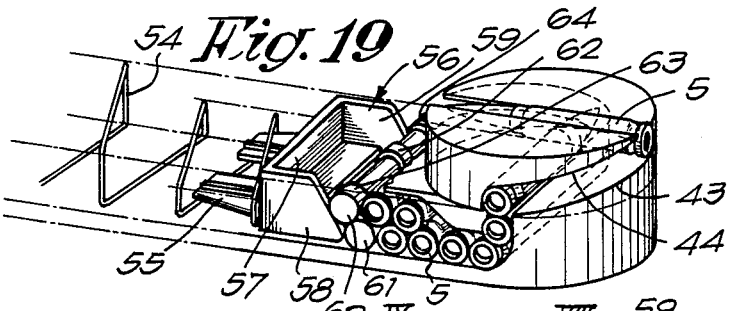
FIG. 19 represents, in perspective and schematically, the essential part of the magazine according to the invention, some walls being removed and the magazine being illustrated upside down in order to better illustrate the magazine's operation.
Figure 7:
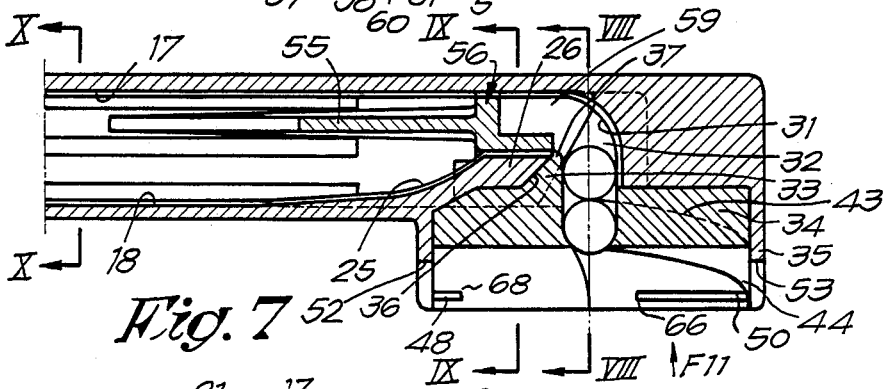
FIG. 7 represents a blown up view of the part indicated by F7 in FIG. 6, the magazine being empty.
Figure 8:
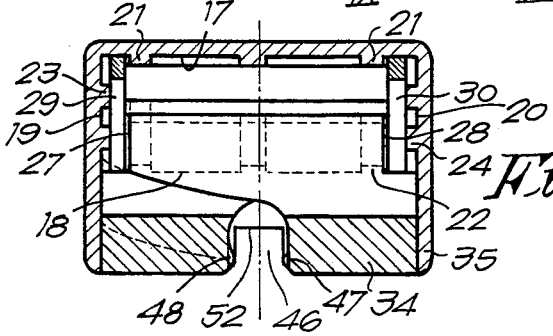
FIGS. 8, 9 and 10 represent cross sections, respectively according to lines VIII—VIII, IX—IX and X—X in FIG. 7.

The magazine consists mainly as shown in the FIGS. 2 through 6 of two parts 3 and 4. The first part 3 constituting the magazine as such, while the second part 4 is constituted by elements allowing for the cartridge's 5 transfer from part 3 to the weapon. Part 3 presents the form of a tube with rectangular transverse section at the walls 6, 7, 8 and 9 while part 4, forming one of the extremities 10-11 of said tube, is constituted by a cylindrical projecting part.

The extremity 10 of the tube 3 is as it is constituted by a wall 12, removable if desired, U-shaped of which the free extremities 13, 14 are folded to one another in order to cooperate with flanges, respectively 15 and 16, provided for this purpose on the walls 6 and 7.

The interior sides 17, 18, 19 and 20 of the walls 6 through 9 present ribs, respectively 21, 22, 23 and 24 in this embodiment which form the guiding element for the cartridges 5.

Due to this the friction between the magazine's walls and the cartridges 5 is reduced to a minimum and one achieves, between the ribs, pits which may contain foreign materials such as grains of sand or similar and the damaging effect of these foreign materials to the smooth movement of the cartridges with respect to the magazine's body is avoided.

The interior side 18 of the wall 7 intended to be placed against the weapon's frame, presents a skew 25 the free extremity of which presenting an extension 26. The width of the skew 25 and the extension 26 is such that a free space respectively 29, 30, remains between their lateral sides 27, 28 and the neighboring ribs 23, 24. As shown by the drawings, said ribs 22 stop at the free extremity of the extension 26.

The distance between the ribs 22 provided for on the extension 26 and the ribs 21 provided for on the interior side 17 of the wall 6 is slightly greater than the external diameter of the cartridge 5, while the distance between the ribs 21 and 22 provided for on the interior sides 16, 17 of the walls 6 and 7 is slightly smaller than twice said external diameter of a cartridge 5.

The interior side 17 of the wall 6, as well as the ribs 21 are extended near the free extremity of said extension 26 by a curved guiding surface 31 applied in part 4 of the magazine. This surface's free extremity defines one side of an oblong port 32 while its other sides are defined by the interior sides 19, 20 and the walls 8, 9, on the one hand, and a rib 33 provided for on a built up cylindrical element 34 placed in the projecting cylindrical side 35 of part 4 of the magazine 2, on the other hand.

This cylindrical element 34 constitutes the cartridges 5 transfer element from the magazine as such or part 3 of the magazine towards the weapon equipped with such magazine. Element 34 can be affixed to the wall 35 by any means for instance by means of an appropriate adhesive compound.

Rib 33 is applied to the sloped extremity 36 of said extension 26 and is equipped with a lip 37 which catches in the ribs 22 provided for on extension 26. Its width is equal to the width of said extension 26.

Underneath said rib 33, the element 34 shows a part 38 whose form is such that it adapts to the local form of the corresponding part of skew 25, respectively extension 26 and whose width is equal to the width of said rib 33.

Figure 13:
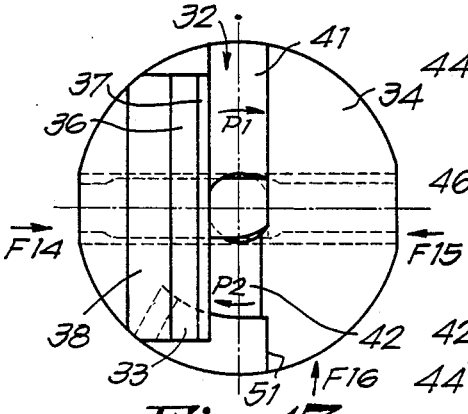
FIG. 13 represents a view according to arrow F13 in FIG. 12.
Figure 14:
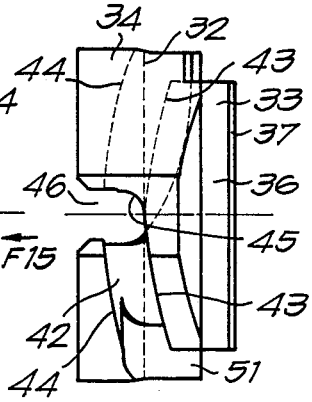
FIGS. 14, 15 and 16 represent views respectively according to arrows F14, F15, F16 in FIG. 13.
Figure 15:
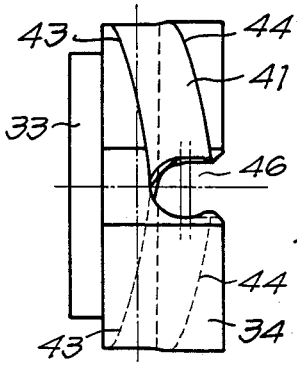
Figure 16:
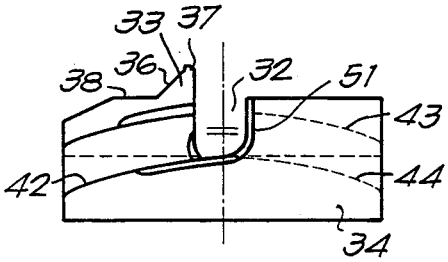

Aforementioned port 32 allows access to two skews, respectively 41 and 42, turning at an angle of 90 degrees according to arrows P1, P2 in FIG. 13, these skews being each delimited by two similar helical planes, respectively 43 and 44. The upper plane's 43 free extremities ending each with a curved part 45 emerging in a second oblong port 46 located in the longitudinal axis of the magazine.

Figure 11:
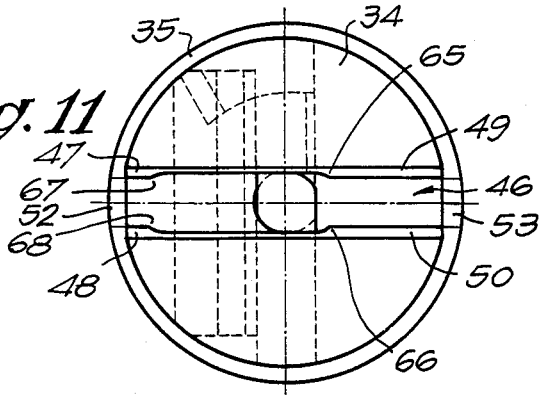
FIG. 11 represents a view according to arrow F11 in FIG. 7.
Figure 9:
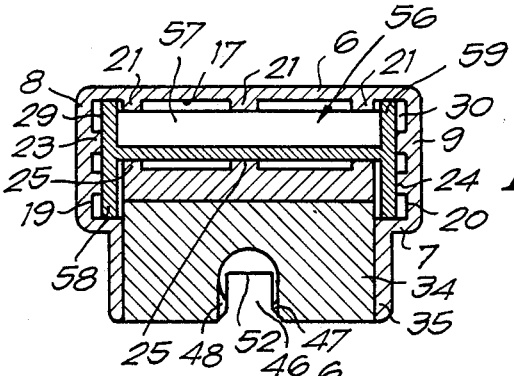
Figure 10:
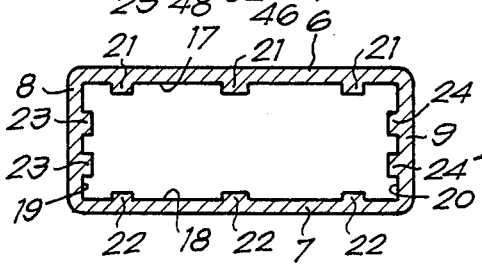

As shown previously, more particularly in FIG. 11, the longitudinal sides of port 46 form at their extremities two areas near to one another, respectively 47, 48 and 49, 50.

The length of the areas 47, 48 is of a few millimetres only, while the length of areas 49, 50 is of one third of the length of port 46.

Finally, the bottom side 44 of the skew holding the front parts or conical bullets of the cartridges is equipped with a hollow area 51.

In the port's 46 axis of wall 34 of part 4 of the magazine two rectangular notches, respectively 52 and 53, are provided for.

Within tube 3, finally, a spring 54 whose rear end rests on aforementioned wall 12 is housed whose front end is affixed to the tail 55 of a transporter or pushing element 56 consisting in this case of a central part 57 and two lateral rims, respectively 58 and 59, for instance in the form of a rectangular trapezium whose front curved rim is directed toward part 4 of the magazine, the longest base of the trapezium being adjacent to aforementioned wall 6. The lateral rims 58 and 59 are placed in such way and possess such a thickness to port into aforementioned spaces 29, 30.

Between the pushing element 56 and the cartridges 5 as such, two false cartridges, respectively 60 and 61, are provided for, in this case formed by cylindrical rods provided at the center and at both ends with a cylindrical shouldering, respectively 62, 63 and 64 and whose in between distances correspond with the in between distance of ribs 21, resp. 22.

The magazine's operation as described is simple and as follows.

The loading of magazine 2 can be made, either by introducing the cartridges 5 through the port 46 of the cylindrical element 34, or by the rear while removing wall 12 and the spring 54 together with the pushing element 56.

It is obvious that at that time the cartridges 5 are being pushed by the spring's 54 action and by the intervening of the pushing element 56 and the false cartridges 60, 61 towards part 4 of the magazine.

Due to this action the cartridges 5 end up, one after another, in the passage formed between wall 6 and extension 26, then through port 32 and the skews 41, 42, near to port 46, from where the transfer of the cartridges 5 from the magazine chamber towards the external part of the magazine while altering these cartridge's direction over an angle of 90 degrees.

The cartridge, located at that time in front of port 46, is held in the magazine thanks to the presence of extremities 65, 66 in the areas 49, 50, on the one hand, and the next cartridge, on the other hand, which pushes the initial cartridge against aforementioned extremities 65, 66.

Figure 17:
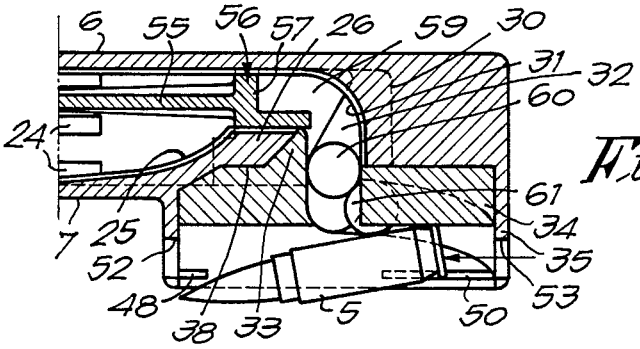
FIGS. 17 and 18 represent a cross section of two positions in the magazine's operation.

The first cartridge is thus located in position as shown in FIG. 17.

Figure 18:
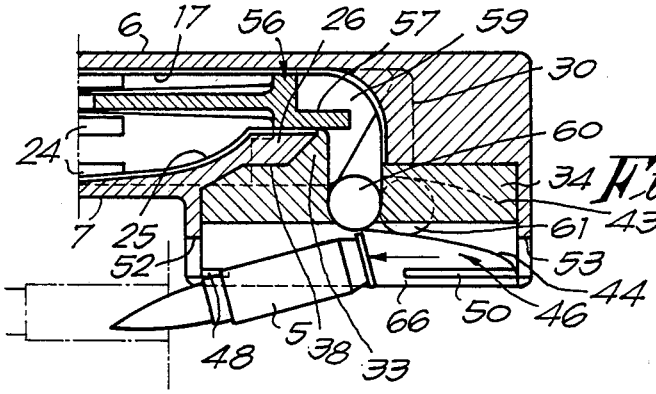
Figure 12:
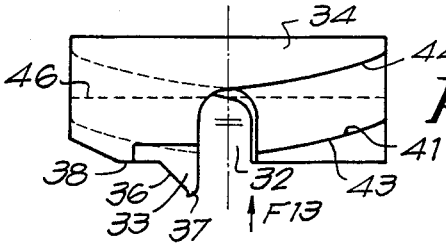
FIG. 12 represents a view according to arrow F12 in FIG. 11, the wall enclosing the transfer element of the cartridges being removed.

At that time it is sufficient that the weapon's breech hits the rear end of the first cartridge to move it towards the weapon's barrel. During this displacement the cartridge will remain in contact with the extremities 65 and 66 of the areas 40 and 50 which results in that the initial cartridge, while being pushed outward of port 46 by the combined action of the breech and the next cartridge, is being moved, under a set angle, see FIG. 18, towards and then into the weapon's barrel.

The complete emptying of the magazine is ensured by the presence of the false cartridges 60, 61 which allow for the last cartridge's 5 delivery in front of port 46.

In actual fact, the last cartridge will at that time be pushed by the false cartridge 61 to the position as shown in FIG. 17, any following angular movement of the false cartridge 61 being stopped by the presence of the hollow area 51 in the bottom side 44 of skew 42.

The constituent parts of the magazine according to the invention, except for the spring 54 and possibly of the false cartridges 60, 61 will be preferably made in an anti abrasion and auto lubricating material, for instance impact polycarbonate.

It is obvious that numerous changes can be made to previously described example without leaving the scope of present invention.

I claim:

1. A longitudinal magazine for individual weapons such as guns, of a type that can be mounted on an upper part of the weapon extending parallel to a longitudinal axis of the weapon, comprising: a first storage part (3) formed by a tube in which cartridges (5) are stored with their longitudinal axes generally perpendicular to a longitudinal axis of the magazine (2); a second transfer part (4) comprising a transfer element (34) defining on both sides oblong parts (32–46), having two skews (41-42) extending over an angle of 90 degrees, one of the ports (32) constituting the connection between storage part (3) and transfer part (4) while the other port (46) constitutes the connection between the transfer part (4) and the weapon (1) with which the magazine (2) cooperates; and, biasing means (54) inside the storage part (3) for transferring the cartridges (5) from the storage part, through the transfer part and into the weapon.

2. A magazine according to claim 1, wherein the first storage part (3) comprises a tube having walls with rectangular transverse cross section (6, 7, 8 and 9), whose internal height is slightly smaller than twice the external diameter of a cartridge (5) and whose internal width is slightly bigger than the length of a cartridge (5), a rear extremity (10) of storage part (3) consisting of a wall (12).

3. A magazine according to claim 1, wherein the first storage part (3) comprises a tube with walls defining a rectangular transverse cross section (6, 7, 8 and 9), whose interior sides (17, 18, 19 and 20) have at least two guiding ribs, respectively (21, 22, 23 and 24) forming guiding elements for the cartridges (5), the distance between upper and lower ribs (21-22) of the magazine being slightly less than twice the diameter of a cartridge (5) while the distance between lateral ribs (23-24) of the magazine is slightly bigger than the length of the cartridge (5), a rear extremity (10) of the storage part (3) consisting of a wall (12).

4. A magazine according to claim 2 wherein the rear extremity wall (12) is fixed to the storage part.

5. A magazine according to claim 2 wherein the rear extremity wall (12) is removable from the storage part.

6. A magazine according to claim 3 further comprising a wall projecting from a side (35) provided on aforementioned storage part (3), to accommodate the transfer element (34).

7. A magazine according to claim 6 wherein the interior sides (17-18) and the guiding ribs (21-22) extend to a first port (32) extending between the transfer element (34) and the storage part.

8. A magazine according to claim 7, wherein a first side (17), and its associated guiding ribs (21), form a curved guiding surface (31) defining one side of the aforementioned first port (32).

9. A magazine according to claim 8 wherein a second side (18), and its associated guiding ribs (22) form a skewed surface (25) having an extension (26) defining a second side of the aforementioned first port (32).

10. A magazine according to claim 9 wherein a perpendicular distance between the first side (17) and the extension (26) respectively measured between the guiding ribs formed on the first and second side, side at the location of the extension is slightly bigger than the external diameter of a cartridge (5).

11. A magazine according to claim 7 wherein the first port (32) communicates with two descending skews (41-42), each delimited by two helical planes, extending over 90 degrees which, in turn, communicate with a second port (46) aligned with the longitudinal axis of the magazine.

12. A magazine according to claim 11 wherein the wall projecting from the side (35) of the storage part defines two diametrically opposed notches (52-53) extending generally parallel to an axis of second port (46).

13. A magazine according to claim 2 wherein the second port (46) has longitudinal sides having areas with reduced lateral dimensions.

14. A magazine according to claim 13, wherein the areas of reduced lateral dimension (47-48) are located at an extremity of the second port (46) adjacent a barrel of the weapon (1) their length being of only a few millimetres.

15. A magazine according to claim 13, wherein the areas of reduced lateral dimension (49-50) are located at a farthest extremity of the second port from a barrel of the weapon (1) their length being approximately one third of the second port's (46) length.

16. A magazine according to claim 2, wherein the biasing means (54) urging the cartridge's (5) transfer from the magazine (2) comprises a spring having a rear end resting on rear extremity wall (12) and a front end resting on a pushing element (56) for the cartridges (5).

17. A magazine according to claim 16, wherein the pushing element (56) comprises a central part (57) and two lateral rims (58-59) cooperating with the cartridges (5) for the transport through the magazine (2).

18. A magazine according to claim 17 wherein the lateral rims (58-59) form a rectangular trapezium having a curved side facing towards the cartridges (5), a large base of the trapezium being adjacent to an upper side (6) of the magazine tube and the height of the pushing device being slightly smaller than the distance between the walls (6-7), defining the magazine tube.

19. A magazine according to claim 18 further comprising at least one false cartridge (60-61) placed between the cartridges (5) and the pushing element (56).

20. A magazine according to claim 19, wherein each false cartridge is formed by a cylindrical rod having at least two cylindrical shoulders (62-63-64).

21. A magazine according to claim 20 wherein one of the shoulders (62-63-64) has a diameter approximately equal to an external diameter of a cartridge (5).

22. A magazine according to claim 21 further comprising means associated with the transfer element (34) to stop the false cartridge when the magazine (2) is empty.

* * * * *

UNITED STATES PATENT AND TRADEMARK OFFICE

CERTIFICATE OF CORRECTION

PATENT NO. : 4,905,394

DATED : March 6, 1990

INVENTOR(S) : Rene PREDAZZER

It is certified that error appears in the above-identified patent and that said Letters Patent is hereby corrected as shown below:

Column 6, line 23

Claim 13, line 1 should read as follows:

-- . . . according to claim 12 . . . --

Signed and Sealed this

Twenty-third Day of July, 1991

*Attest:*

HARRY F. MANBECK, JR.

*Attesting Officer*

*Commissioner of Patents and Trademarks*